United States Patent [19]

Kenyon

[11] Patent Number: 4,735,289

[45] Date of Patent: Apr. 5, 1988

[54] DISPENSING APPARATUS AND DEPOSIT APPARATUS FOR DRIVE UP MACHINES

[76] Inventor: Anthony Kenyon, 124 Belsize Road, London NW6 4BG, England

[21] Appl. No.: 862,277

[22] Filed: May 12, 1986

[30] Foreign Application Priority Data

May 14, 1985 [GB] United Kingdom ..... 8512153
Aug. 12, 1985 [GB] United Kingdom ..... 8520214
Oct. 15, 1985 [GB] United Kingdom ..... 8525362

[51] Int. Cl.[4] ..... E05G 7/00

[52] U.S. Cl. ..... 186/37; 186/41; 186/53; 109/19; 340/942

[58] Field of Search ..... 186/37, 53, 55, 56, 186/41; 109/19; 235/379, 383; 232/43.3, 43.4; 340/942, 943; 367/96; 356/378; 342/23, 27

[56] References Cited

U.S. PATENT DOCUMENTS 2,366,152 12/1944 Lauterbach ..... 340/942 X
2,703,200 3/1955 Burbank ..... 232/43.4 X
3,077,243 2/1963 Buros ..... 186/37
3,647,026 3/1972 Alexander et al. ..... 186/53
3,732,555 5/1973 Strenglein ..... 342/27 X
4,084,149 4/1978 Driver ..... 109/19 X
4,123,748 10/1978 Otani ..... 342/27 X
4,420,751 12/1983 Paganini et al. ..... 367/96 X

*Primary Examiner*—F. J. Bartuska
*Attorney, Agent, or Firm*—Helfgott & Karas

[57] ABSTRACT

A dispensing apparatus is provided for use from an open window of a stationary vehicle. The position of the open window is optically or acoustically sensed and a data input and dispensing component is moved by a carriage mechanism in response to the sensed signals to a position adjacent to the open window. Input of data can also cause the component to be moved between this window position and an at rest position at which material may be collected and/or dispensed.

31 Claims, 9 Drawing Sheets

DISPENSING APPARATUS AND DEPOSIT APPARATUS FOR DRIVE UP MACHINES

TECHNICAL FIELD AND BACKGROUND ART

This invention relates to dispensing apparatus for an automatic bank teller or vending machines where the machine is to be used by a person within a vehicle. In particular, the apparatus is an attachment to or forms part of an automatic bank teller such as those commonly provided by banks to enable their customers to withdraw money from their accounts. Although the invention is described in this specification as being particularly relevant to automatic bank tellers, it should be realised that the invention is applicable to other types of dispensing machines.

A person attempting to operate an automatic bank teller from within a stationary road vehicle can and often does experience considerable difficulty in reaching the controls of the machine, i.e. the keyboard, which is used to input data from the user and a security card as well as reaching the money output point on the machine. The difficulty is caused by the automatic bank teller being located in a fixed position in relation to a vehicle. This means that there may be a considerable horizontal distance between the side of the vehicle parked adjacent the machine and the controls of the machine. In addition, different vehicles have a different window height from the ground such that a parked vehicle or driver of a low vehicle will have to reach up whereas the driver of a high vehicle will have to stretch downwards. This results in the driver being discouraged from using existing "drive up" automatic bank tellers. Analogous problems are experienced when machines of other types are used as "drive up" machines. It is an object of the present invention to attempt to provide a dispensing apparatus which can be fitted to existing machines of the type previously described which enables the machine to be more readily used by a person in a stationary road vehicle.

The present invention attempts to provide a dispensing apparatus which provides a service between a machine such as an automatic bank teller and a person in a vehicle at a remote point to the position of the automatic bank teller and this varies according to the type of vehicle being used.

SUMMARY OF THE INVENTION

According to the present invention, there is provided a dispensing apparatus for use by a person in a stationary vehicle adjacent the apparatus, the apparatus having detection means capable of determining the position of an open window, carriage means capable of providing horizontal and vertical movement of a data input component to a position adjacent the open window such that the apparatus can be more easily operated by a person in the vehicle.

The present invention further provides apparatus for use from an open window of a stationary vehicle, the apparatus having detection means capable of determining the position of the open window, carriage means activated by said detection means capable of providing horizontal and vertical movement of a data input and dispensing component, the data input and dispensing component being capable of moving from a rest position to a position adjacent the open window such that the apparatus can be operated by a person toll machines, where data has to be input, or food or drink dispensers.

Preferably the apparatus is in the form of an apparatus which can be fitted to an existing vending machine mounted in a suitable roadside location. This form of the apparatus has the advantage that minimal modification of the construction of the existing automatic bank teller is required and can allow the dispensing apparatus of the present invention to be attached thereto. However, it is to be understood that the present invention includes apparatus which may be incorporated into the construction of a machine when it is manufactured.

In an embodiment of the invention where the dispensing apparatus is associated with an automatic bank teller, the data input and dispensing component can incorporate existing apparatus for reading a data card, a keyboard to enable the person in the vehicle to input the necessary instructions for a transaction to the automatic bank teller and money handling machinery to enable any money from the automatic bank vending machine to be transferred to the person in the vehicle. The data input and dispensing component may also be capable of supplying information appropriate to the transaction such as a bank statement by means of a visual display or hard copy printout.

In a preferred embodiment of this type of machine, the card reading apparatus and keyboard may be of substantially conventional type and may be connected to an automatic bank teller so that data can be entered into the antomatic bank teller and cash can be dispensed from it to the apparatus of the present invention. When valid instructions for the transaction have been completed by the person in the vehicle, the data input and dispensing component will return to its rest position against an automatic bank teller which will dipense the money requested, transfer it to the dispensing apparatus which in turn will return to the position adjacent a person in a vehicle.

The data and dispensing component then transfers the money to the position adjacent to the vehicle windows for retrieval by the person in the vehicle. Preferably, this transfer is achieved by the carriage mechanism moving the data input and dispensing component to a money outlet point where it picks up the money. The apparatus returns to the position adjacent the car window and the person in the vehicle retrieves the money completing the transaction.

It is envisaged that an automatic bank teller fitted with the apparatus is mounted at an appropriate roadside location, such as by the side of a road, a forecourt of a filling station, a car park, etc.

A person in a vehicle desiring to use the machine and apparatus will park the vehicle adjacent the machine so that an open window of the vehicle is opposite the apparatus. The window is opened and the vehicle parked in accordance with instructions visibly displayed near the machine and apparatus. The presence of the vehicle is sensed by a detecting means which may be of either optical, acoustic or weight sensing type. A motion detection means is employed to determine when the vehicle is stationary. The detection means will produce signals which are transmitted to a control device, which device controls the operation of the apparatus. The motion detection means may operate by waiting for a brief period of time to confirm that the vehicle is stationary; and preferably is a detection means employing the doppler effect to detect motion of the vehicle. When the vehicle is stationary, the control device will activate a detection means to commence scanning to locate the open window of the vehicle.

The detection means must be capable of detecting the car body and may be of either optical or acoustic type and may be the same component as is used to initially detect the presence of the vehicle. The optical detector may be of the infra-red type which detects reflection of infra-red light from the vehicle body. The acoustic type may also reflect sound from the body of the vehicle. The detection means is preferably mounted on a carriage mechanism and is initially close to the road surface, but preferably above the vehicle base line, i.e. about 60 cms above the road surface, so that when activated by the control device, the detection means will scan vertically upwards. This scanning motion results in the detection means ignoring the space between the vehicle underbody and the road, sensing the body of the vehicle and then the space provided by the open window, since if the vehicle is parked according to instructions the open window should be opposite the carriage mechanism and associated detection means. The control is pre-programmed so that on detection of the first open space (i.e. the open window or in the case of a comvertible, the space above the vehicle door) the carriage mechanism will stop the upward motion of the detection means thus locating the height of the window. After stopping the upward motion of the detection means, the control device initiates a horizontal motion of the carriage mechanism. This horizontal motion is toward the open window of the vehicle, which moves with it a second detection means, which maybe the same as that used to detect the height of the window. The second detection means may be an optical or acoustic detection means or may be a soft touch switch located at a position below the height of the window so that it will contact the vehicle body. The purpose of this motion is to determine the horizontal distance of the vehicle window from the apparatus. In the preferred embodiment where an optical or acoustic detection means is used, contact with the vehicle body is avoided. The detection means causes the horizontal motion to stop thus determining the position of the window.

In a preferred embodiment of the invention, the aforementioned carriage mechanism carries not only the detecting means but also the data input and dispensing component, i.e. keyboard of the apparatus which enables the operation of the automatic bank teller by the person in the vehicle. The details of the construction of this component depend upon the particular type of automatic bank teller with which the apparatus is associated. Sensing means in the component can detect the completion of a valid transaction and the assembly returns to the initial starting or rest position.

In a further embodiment of the invention, the dispensing apparatus is provided with a facility which enables a user to deposit documents or money in a safe receptacle, and thereby transfer money to, for example, a bank account. Static deposit facilities are known, wherein the money or documents are placed in the safe receptacle by a user pushing them through a secure aperture which is provided in the housing of the receptacle. The money or documents deposited in the receptacle may either be retained therein for later, manual removal by an appropriate authority, or removed by automatic machinery for processing. In this embodiment of the invention, a safe deposit facility similar to that described above may be incorporated in the housing or adjacent to the automatic bank telling machine. A device capable of receiving a package containing the documents and/or money is included in the data input and dispensing component of the apparatus. Operation of the deposit embodiment of the apparatus is initially similar to that of the previously described embodiments up to the stage where the data input and dispensing component is first adjacent an open window of the vehicle. At this position the user will identify himself to the machine by way of his data card and/or the keyboard on the data input and dispensing component, so that the machine can confirm his authority to make a transaction. The user can then operate the keyboard of the data input and dispensing component to select either to withdraw money from the machine, in which case operation of the apparatus is as previously described, or to make a deposit by way of the apparatus.

When the user selects to make a deposit, an envelope or similar packaging means may be dispensed from the data input and dispensing component. Having identified by way of the keyboard of the data input and dispensing component, to what account he wishes the money or documents to be transferred, the user deposits the money or documents contained in the envelope in the deposit device. The user's data card is then returned to him, and the carriage mechanism operates to move the data input and dispensing component to a position adjacent the aperture of the safe receptacle. On reaching this position the deposit apparatus operates to transfer the envelope containing the money or documents to the static safe receptacle. The apparatus then moves to the initial rest position ready for the next customer.

The apparatus of the present invention can be programmed to enable the remote selling of insurance, stocks or shares, or similar services. These types of services require considerably more interaction between the user and the apparatus than in those previously described. To enhance communication between the user and the machine so that these services may be more easily provided, a touch-sensitive screen may also be included in the data input and dispensing component combined with interactive video if required. With this type of screen instructions for operation of the apparatus are displayed visually, together with the decisions which a user may make during a transaction. To make a decision the user merely touches an appropriate proportion of the screen. A touch-sensitive screen enables more information display and data input to be achieved in a more compact manner than with other display and data input devices, and simplifies operation of the assembly.

The assembly can be controlled by means of an electronic control device such as a micro-processor preprogrammed to respond to electrical signals of the detection means. The device controls the motion of the carriage mechanism by means of motors driving the carriage mechanism. The apparatus may be provided with fail-safe features. For example, if the sill of the open window or the vehicle body cannot be detected, the apparatus returns to the rest position. A further preferred safety feature may be provided by a facility which, detects any motion of the vehicle while the data input and dispensing component is extended and in response to such detected motion causes rapid withdrawal of the data input and dispensing component to avoid damage to the apparatus or the vehicle. Also, if the apparatus is misused, for instance a stolen security card is used, the apparatus can retain the card and return to the rest position.

In the event that the dispensing apparatus is used in association with a vending machine for dispensing items other than money, the data input and dispensing component will be modified to be capable of handling the items dispensed such modification depending specifically on the type of items. In one preferred embodiment of this type, the items to be dispensed may be displayed behind toughened or armoured glass in a cabinet located at the road side to be visibly displayed to the user in a vehicle parked adjacent to the machine. The user in the vehicle may select the items he wishes to purchase and instruct the apparatus to deliver such items to the open vehicle window by means of the data input and dispensing component in a similar fashion to that described in the previous embodiments of this apparatus. The machine may then transfer either the items visibly displayed, or similar items from a store in the machine to an outpoint in the machine where it may be received by the data input and dispensing component for transfer to the vehicle window. Transfer of the items to the output point of the machine is achieved by automatic handling mechanisms in the machine such as, conveyor belts or robot arms.

An alternative preferred embodiment of an apparatus for dispensing items other than money need not have a display cabinet of the type described above, but may have a visual display unit mounted in or adjacent the data input and dispensing component. The visual display unit is capable of displaying a visual representation of the items available for sale, to enable a user in a vehicle to select the items he wishes to purchase.

Security for the goods held in the dispensing machine of the present invention is provided by means the static part of the vending machine which may be armoured and provided with alarm systems as deemed appropriate. It will be realised that the effects of accidental or intentional damage or vandalism to the carriage mechanism or data input and dispensing component may be minimised if desired by armouring the carriage mechanism and data input and dispensing component.

The apparatus can be provided with an independant and internal power source which will operate in the event of failure of an external mains supply power source, or may be powered solely from an internal power source.

BRIEF DESCRIPTION OF THE DRAWINGS

The present invention will be further described by way of example only with reference to the accompanying illustrative drawings, in which.

FIGS. *3a–f* are a diagrammatic sequence of the present invention in operation.

Figure 4:
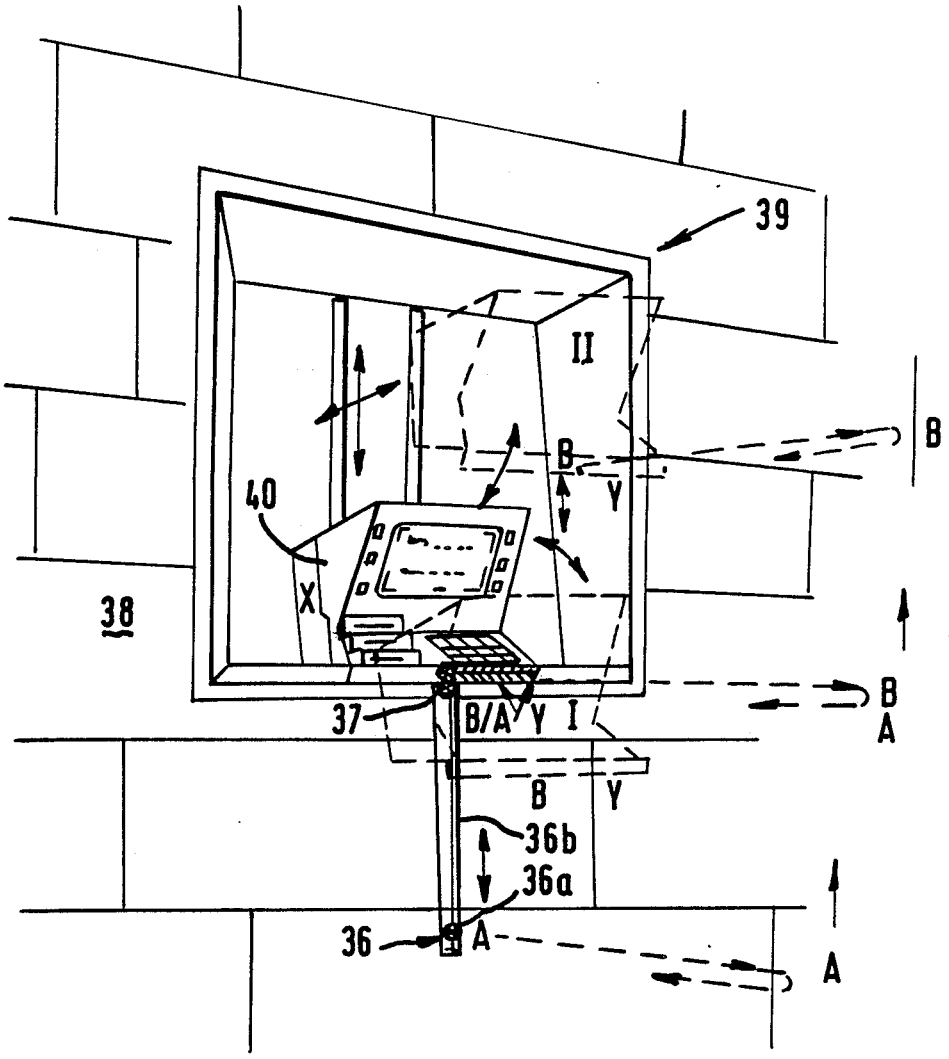

FIG. 4 is a second preferred embodiment of the invention having two detection means which may cooperate to determine the height of an open window.

Figure 5:
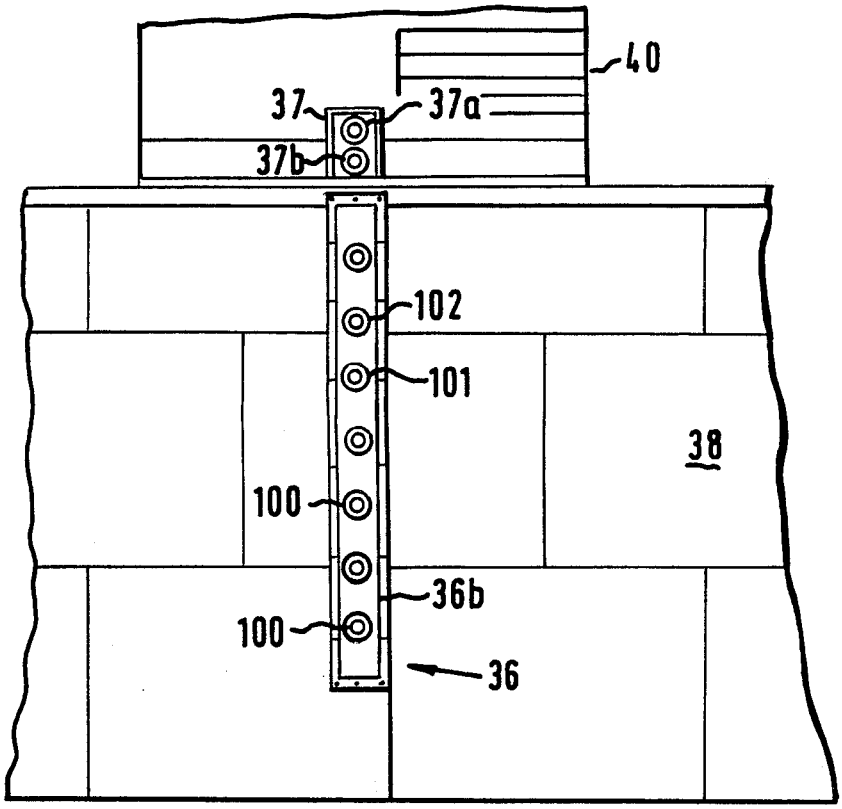

FIG. 5 is an enlarged illustration of an alternative type of optical sensor means for use in the embodiment of FIG. 4.

Figure 6:
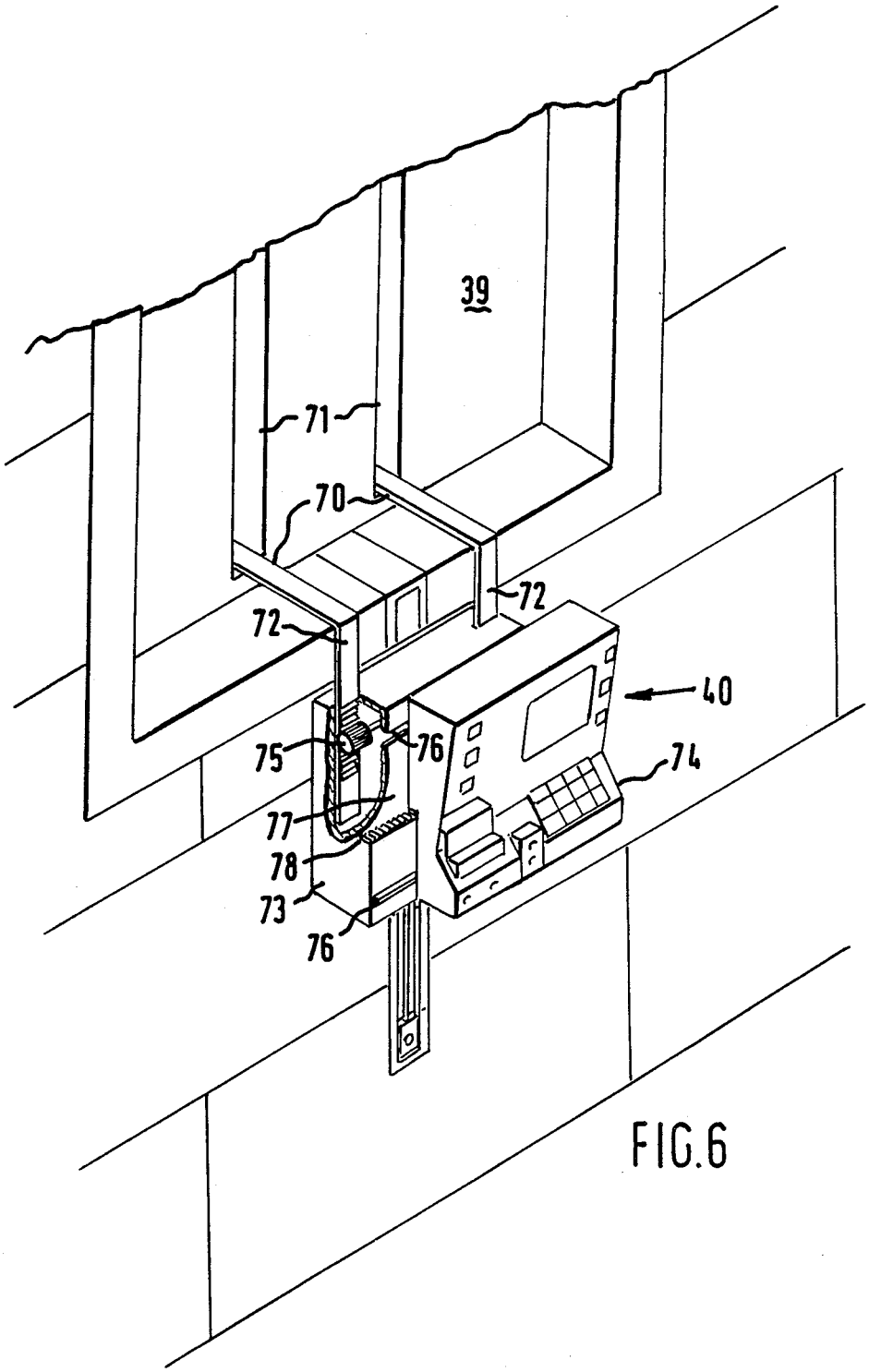

FIG. 6 shows a perspective view of one possible carriage mechanism for use with the embodiment of FIG. 4.

Figure 7:
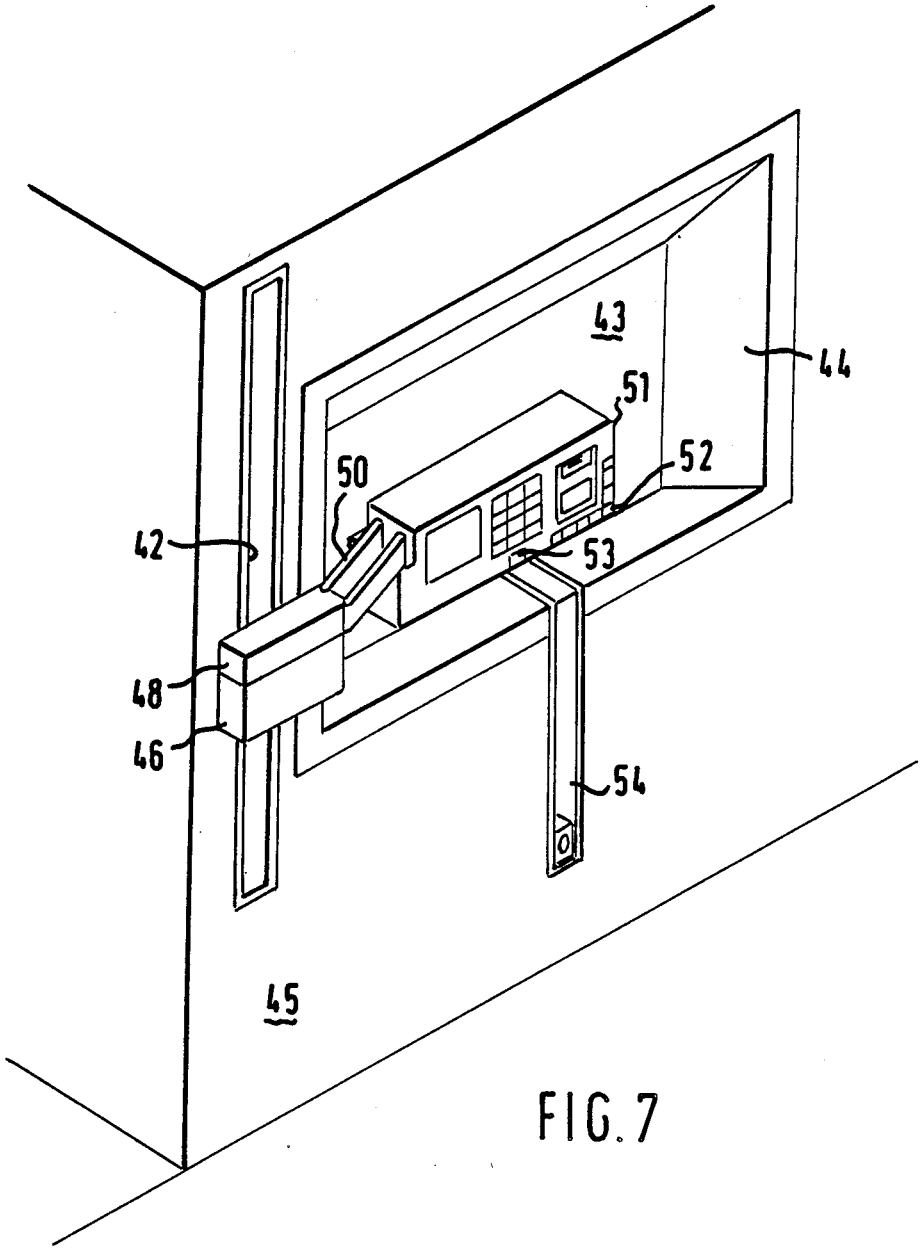
Figure 8:
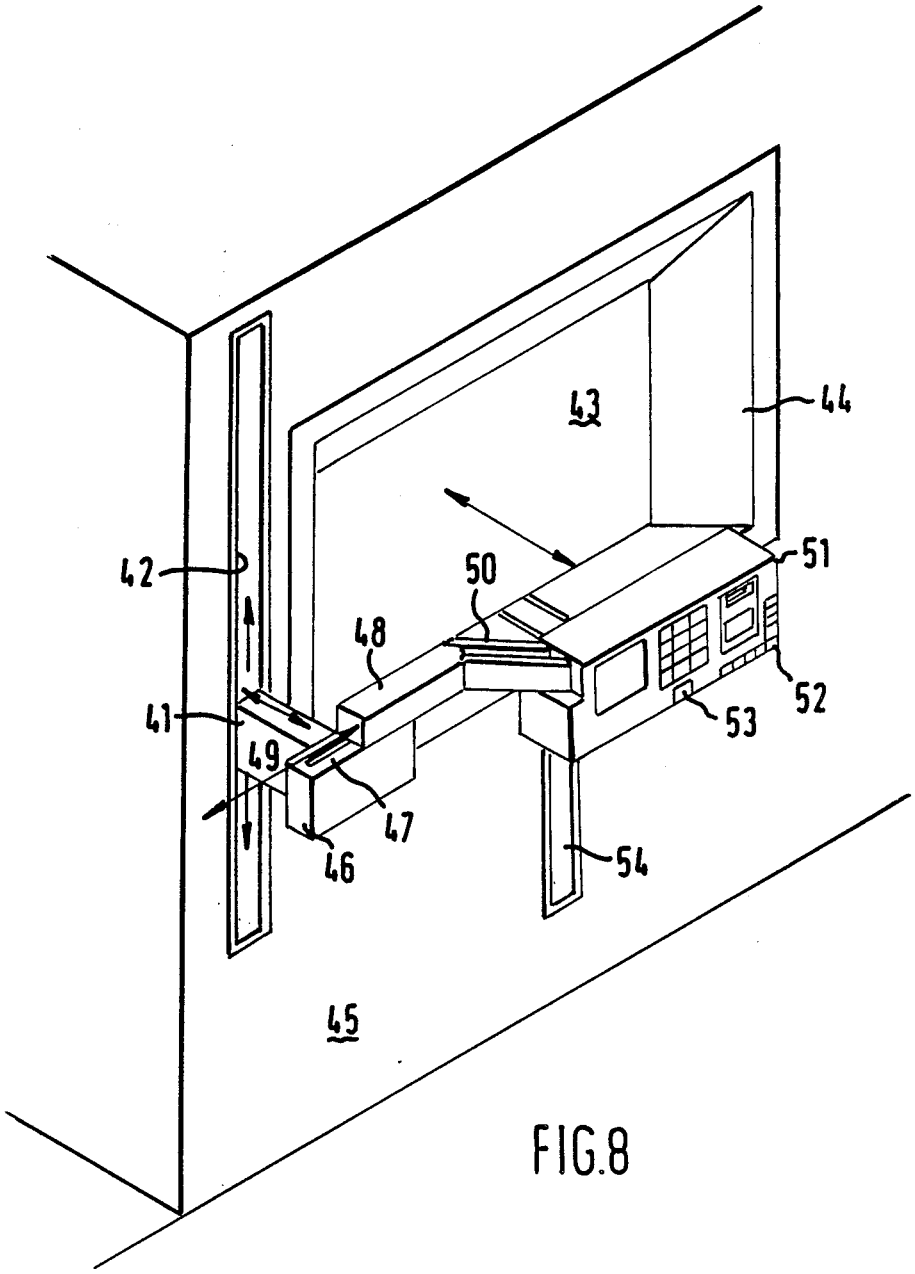

FIGS. 7 and 8 are perspective views of the construction of a third possible carriage mechanism capable of being attached to one side of an existing automatic bank teller machine.

Figure 9:
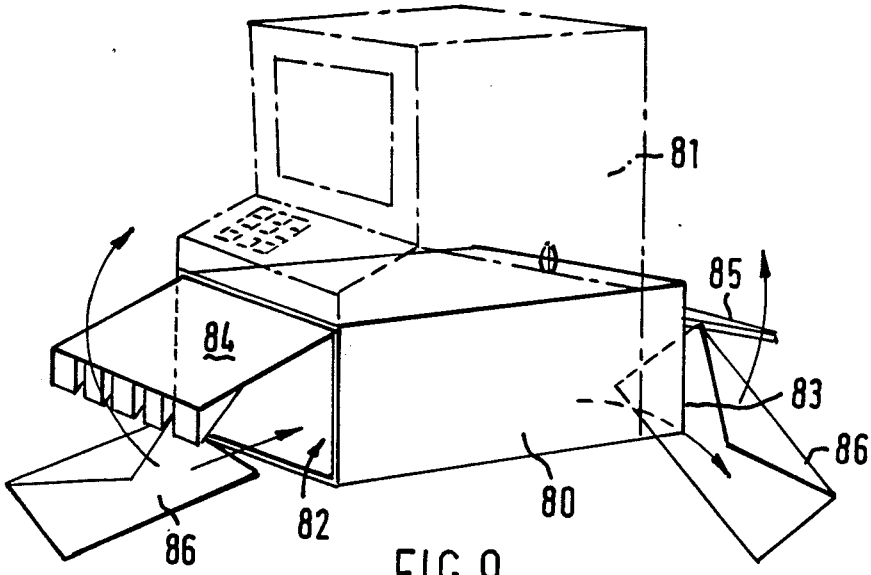

FIG. 9 is a perspective view of one embodiment of data input and dispensing component which includes a deposit apparatus.

Figure 10:
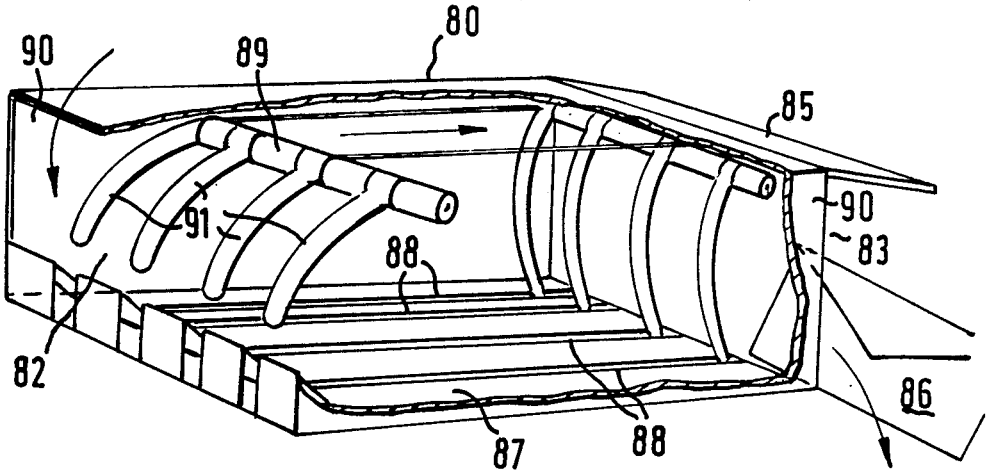

FIG. 10 is a perspective view of the deposit apparatus included in the data input and dispensing component of FIG. 9 showing its internal mechanism.

Figure 11:
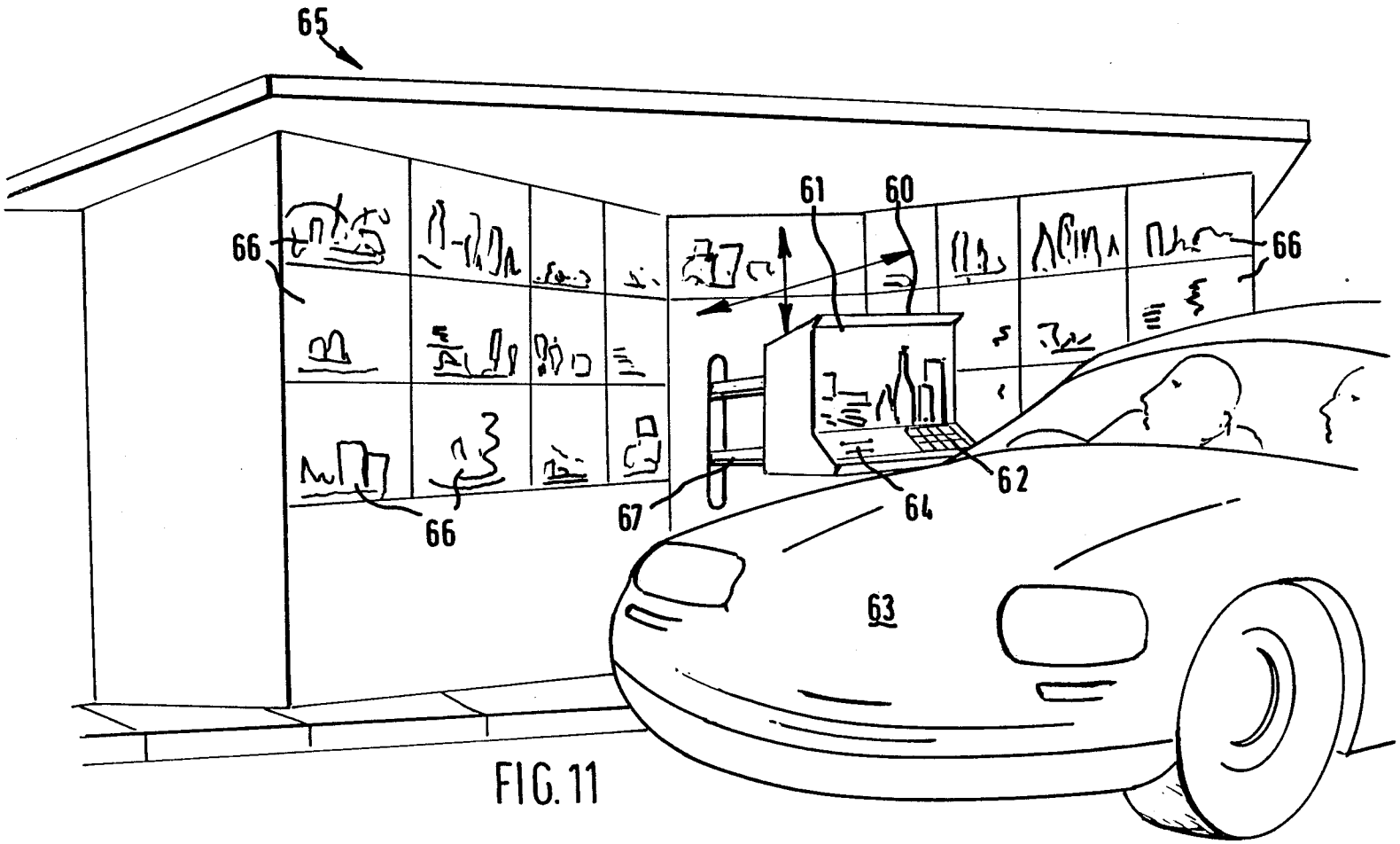

FIG. 11 is a perspective view of one form of the present invention capable of dispensing items other than money.

DETAILED DESCRIPTION OF THE DRAWINGS

Figure 1:
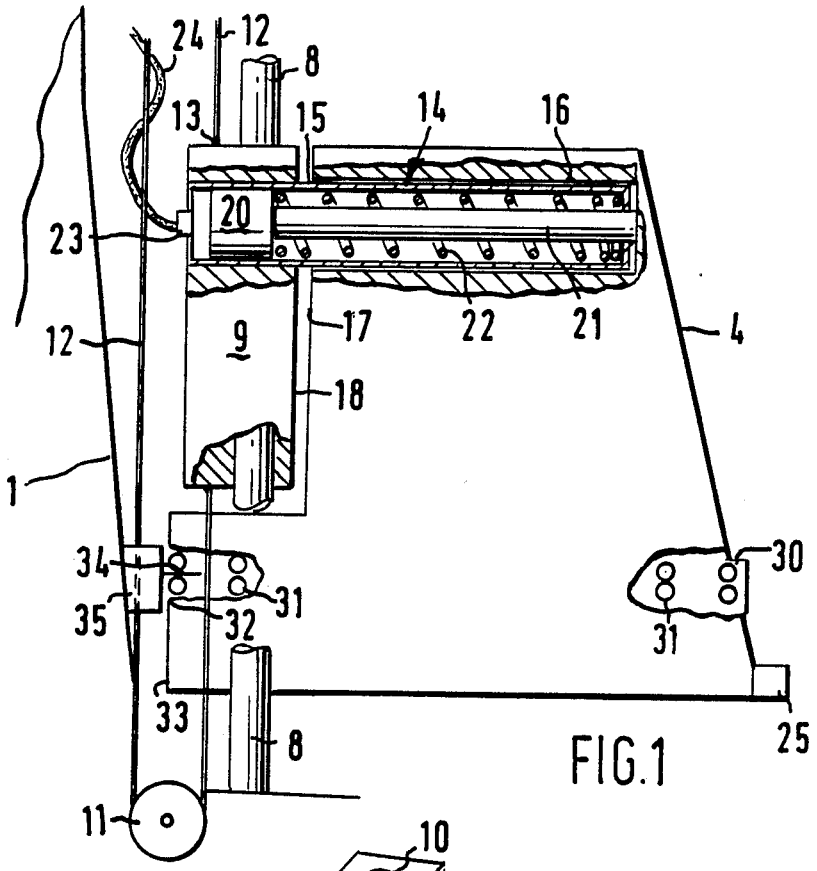
FIG. 1 is a partially cut away side view of the present invention.
Figure 2:
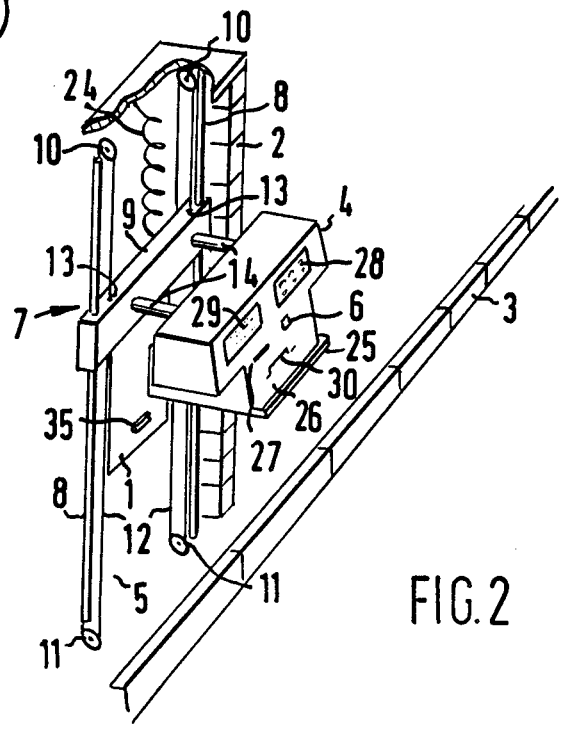
FIG. 2 is a perspective view of the apparatus, on a reduced scale, fitted to an automatic bank teller machine, mounted in a roadside location.

In the embodiment of the invention illustrated in FIGS. 1 and 2, the dispensing apparatus is fitted to a substantially conventional automatic bank teller machine 1, mounted in a roadside housing 2 close to the kerb 3 of a road.

The position of a data input component 4 when not in use is close to the ground and to the front of housing 5. This position is the rest position of the data input component. The data input component 4 is provided with an optical sensor device 6 capable of detecting the presence of a vehicle parked adjacent to the machine, and the height of an open window thereof by sensing a ray of light reflected from the vehicle body. (In an alternative embodiment this could be an acoustic sensor device). The sensor device 6 is constantly active so that when a road vehicle is parked opposite the assembly it will be detected by the sensor device 6.

The data input device 4 is mounted on a carriage mechanism generally indicated by 7. The carriage mechanism 7 is capable of moving the data input device in both vertical and horizontal directions, i.e. upwards parallel to the front of the housing 5 and horizontal towards or away from the road and any vehicle parked thereon.

The carriage mechanism 7 may comprise two rigid steel rods 8 mounted vertically in the housing 2 and parallel to each other, so that a rigid steel back plate 9 which is slidably mounted on both rods 8 can move vertically up or down. The rods allow the plates to move closer and parallel to the front surface 5 of the housing 2. The vertical movement of the back plate 9 is provided by two pairs of pulleys, a first pulley 10 of each pair being mounted close to an upper end of one of the rods and a second pelley 11, of each pair, being mounted close to a lower end of one of the rods 8, so that a pulley pair is associated with each of the two rods 8. For each pair of pulleys, a cable is securely fastened to an upper surface 13 of the back plate 9 and passed over the upper pulley 10, which passes downward to the lower pulley 11 and around the lower pulley 11 to be fastened to an underside 14 of the back plate 9. Thus, a continuous loop of the cable 12 is formed around the pulleys 10 and 11, linked by the back plate 9. The pulleys 10 are coupled by means of an electric motor (not shown) which can be controlled to rotate the pulleys in either direction of rotation, causing the back plate 9 to be moved upwards or downwards.

The height of the back plate 9 above the ground is determined by means of a precision potentiometer (not shown) coupled to one of the pulleys 11, so that its resistance to an electrical current flowing through it varies proportionally to the number of rotations of the associated pulley and hence the height of the back plate 9.

The horizontal movement of the carriage mechanism is achieved by means of two pneumatically driven pistons 14 and shown in detail in FIG. 2. Each piston comprises a hollow cylinder 15 which is securely mounted within the back plate 9 and which extends horizontally away from the back plate 9 to fit slidably into a cylindrical cavity 16 provided in the upper back portion 17 of the data input component 4 so that the data input component 4 can be moved to allow the upper back 17 of the component 4 to abut a front face 18 of the back plate 9. A piston 20 is slidably mounted within the cylinder 15 and connected by a connecting rod 21 which extends from the outer face of the piston 20 to pass slidably through the end of the cylinder 15 and connect with the data input component 4. Between the face of the piston 20 and the end of the cylinder 15 is mounted a compression spring 22. The inner end of the cylinder 15 is sealed and provided with a pneumatic fluid inlet 23, attached to a flexible hose 24. To reduce the complexity of the assembly one pneumatic fluid inlet can be provided for both pistons.

On release of pressure, the compression springs 22 expand which causes the data input component 4 to move towards the back plate 9. On increase of pressure, the springs are compressed and the data input component 4 is moved horizontally away from the back plate 9.

The vertical and horizontal motions of the carriage mechanism are controlled by means of a control device mounted within the data input component 4. The control device controls the carriage mechanism by means of electrical signals, which are applied to the electric motor driving the pulleys 10, and a pneumatic pump which provides pressure for the pistons 14. The control device response according to pre-programmed instructions to signals from the potentiometer coupled to the pulley 11, which enables it to determine how high to the ground the component 4 is, to signals from the optical sensor 6, to a optical detector 25 mounted toward a lower edge of the component 4 and to internal sensors which enable it to determine when various stages of a transaction are completed. All the electrical signals to the controller from the sensory equipment are generally transmitted thereto via electrical cable connections, although ultrasonic or infra-red voltages can also be used.

The data input component 4 has mounted in its front facing surface 26 a receptacle 27 for receiving a security card, a keyboard 28 to permit a person using the assembly to input their security code number and instruct the machine during a transaction, a visual instruction display screen 29 which displays instructions as to how to use the machine and a money output point 30. The money output point 30 is coupled via, for example, driver rollers 31 to a money inlet point 32 located in the rear facing surfaces of the component 4 which surface extends vertically below and horizontally rearward of the back plate 9 when the component 4 is retracted on the pistons 14. This inlet point 32 is provided to enable money 34 to be transferred from a money output point 35 of the automatic bank teller machine 1.

Figure 3A:
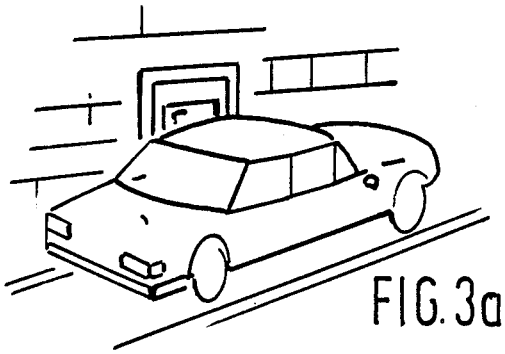
Figure 3B:
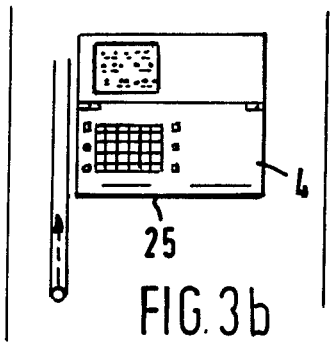
Figure 3C:
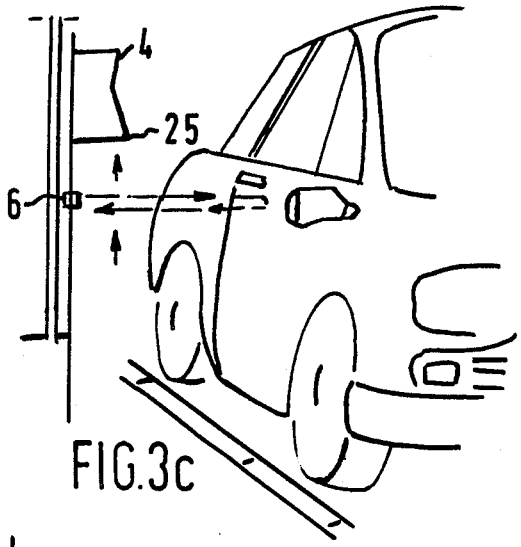
Figure 3D:
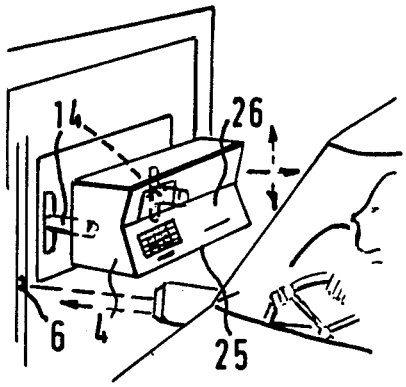
Figure 3E:
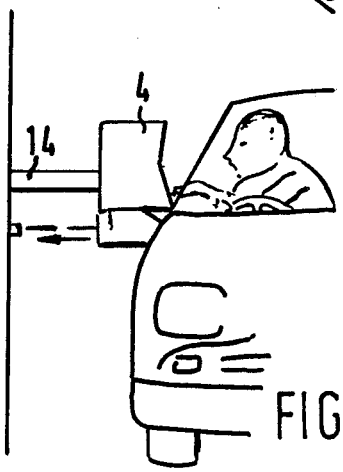
Figure 3F:
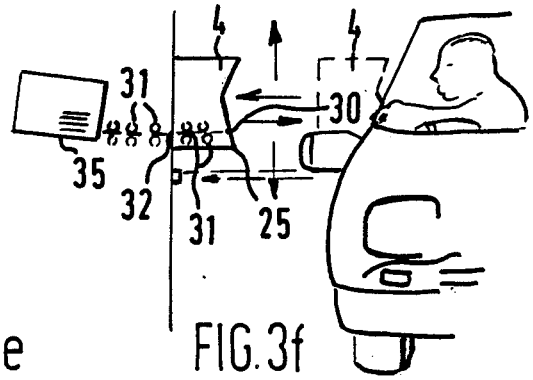

The operation of the assembly is as follows. A person in a vehicle parks opposite the machine so that a window of the vehicle is opposite the apparatus, he then opens the window (FIGS. 3*a* and *b*). The optical sensor 6 detects the presence of the vehicle and the controller responds by waiting for example about four seconds, to ensure that the vehicle is stationary. If the vehicle moves away during this period the machine will remain at its rest position. After the pause, the controller causes the motor driving the pulleys 10 to operate raising the data input component. As the data input component rises, the sensor 6 continues to sense the presence of the vehicle body until it rises over the sill of the open window where it can no longer sense a solid object. At this point, the controller stops the vertical motion having determined the height of the open window. The controller then causes the pistons 14 to move component 4 towards the vehicle (FIG. 3*d*). Since the optical detection means 25, is below the sensor 6 on the data input component 4 it will touch the car body which will cause the horizontal motion of the component 4 to stop. At this point the front surface 26 of the component 4 can be easily reached by the person in the vehicle who uses the equipment previously described on the front surface of the component 4 in a substantially conventional manner to instruct the machine to perform the desired transaction (FIG. 3*e*). The instructions are transmitted to the automatic bank teller machine and the automatic bank teller machine responds to the instructions in substantially conventional fashion. The control device senses the completion of the instruction input, and operates the carriage mechanism to move the data input component 4 from the position adjacent to the window to a money transfer position. At this position the money inlet point 32 is opposite the money output point of the automatic bank teller machine (FIG. 3*f*). When this position is reached the machine ejects the money from its output point 35, and the rollers 34 draw the money into the data input component 4 where it is retained. The data input component is then returned to the position adjacent the vehicle window and the money is ejected from the money output point 30 of the component 4 for removal by the person. When the money has been removed, the transaction is completed and this is sensed by the controller, which returns the assembly to its rest position ready for next use.

Various other sensors may be incorporated to ensure that the apparatus of the present invention avoids projections such as using mirrors, radio aerials etc.

The embodiment shown in FIG. 4 differs from the previously described embodiment in that co-operating optical sensor means 36 and optical sensor device 37 are employed to determine the height of the vehicle open window. A conventional automatic bank teller machine generally indicated by numeral 39 is mounted in a wall 38 at a height of substantially above that of the road surface. For example so that the height of the lower extremity of the automatic bank teller machine 39 is approximately 1 metre above the road surface. A mobile data input component 40 is mounted on a carriage mechanism (not shown) and has a rest position adjacent to the front of and close to the lower extremity of the automatic bank teller machine 39. An optical sensor 37 is mounted toward the front of and at a low point in the data input component 40. An optical sensor means generally indicated by arrow 36 is mounted in a wall 38 beneath the automatic bank teller machine 39 and the data entry component 40. In this invention the data input component 40 may also provide data output if required.

The optical sensor means 36 may be one of two types. The type shown in FIG. 4 has an optical sensor device 36*a* mounted on a carriage mechanism (not shown) which is capable of moving the device 36*a* either up or down within a vertical slot 36*b* in the wall 38. The slot 36*b* extends from a height close to the road surface for example approximately 0.6 meters above the road surface, to a height approximately equal to that of the height of the sensor 37 when the data entry component is in the rest position. The optical sensor devices 36*a* and 37, operate by sensing a beam of light reflected from a vehicle parked adjacent the apparatus. The second type of optical sensor means 36 shown in FIG. 5, has a number of optical sensor devices 100 mounted vertically in the slot 36*b* at regularly spaced intervals from the bottom to the top of the slot 36*b*. In the case of either the first or second described sensor means 36 the slot 36*b* may be covered by toughened or armoured glass to prevent access to the optical sensor devices 36*a* or 100.

In this embodiment the optical sensor means 36 and optical sensor means 37 may co-operate to determine the height of an open vehicle window in the following manner. When a vehicle parks adjacent the apparatus as described in the previous embodiment of this invention the optical sensor device 36*a* of optical sensor means 36 is initially at a rest position, that is towards the bottom of the slot 36*b*. The optical sensor device 36*a* then detects the presence of the vehicle body in response to which it is moved upwards in the slot 36*b* by its carriage mechanism so that it may scan the vehicle body to detect the open vehicle window. Wjen the optical sensor means 36 detects the open vehicle window, which occurs when the optical sensor device 36*a* can no longer sense a bean of light being reflected from the vehicle body, the height of the vehicle window is signalled to a control device. The control device causes the carriage mechanism of the dfata input component 40 to move the component 40 to a position adjacent the open vehicle window. The operation of the apparatus is thereafter similar to that of the previously described embodiment. The operation of optical sensor means 36 shown in FIG. 5 is slightly different in that the sensors 100 do not move vertically. Thus if for example the maximum height of the car body below the open vehicle window is between height sensors 101 and 102, the sensor 101 will detect the vehicle body as will all those beneath it and the sensor 102 and those above it will not detect the vehicle body. Thus the height of the open vehicle window is determined, and operation of the apparatus is thereafter as previously described. In the event that the height of the open vehicle window exceeds the maximum height of the optical sensor means 36 the optical sensor means 36 will not detect the open window and the control device will respond to this by causing the data input component 40 to move upwards thus allowing the optical sensor device 37 to scan for the open window. When the height of the open vehicle window is determined by the optical sensor device 37 the upward motion of the data input component 40 stops and the data input component 40 is moved away from the automatic bank teller machine 39 to a position adjacent the open vehicle window. Operation of this apparatus is thereafter similar to the operation of the previously described embodiment of this invention.

Optical sensor 37 may employ two optical sensor devices 37*a* and 37*b* mounted one above the other as shown in FIG. 5 on the data input component 40. Using the two optical sensor devices 37*a* and 37*b* results in the lower optical sensor device 37*b* always detecting the vehicle body when the data input component 40 is in its extended position adjacent the open window of the vehicle. The upper optical sensor device 37*a* detects only the space provided by the open window of the vehicle. Using this sensor means enhances accurate determination of the height of the vehicle open window. Because of the lower of the optical sensor devices 37*b* will detect the vehicle body below the open window it may be used to determine the horizontal distance between the vehicle body and the data input component 40.

A motion sensor device may be incorporated in the optical sensor means 37, or preferably in the optical sensor means 36. The motion sensor device is capable of detecting any motion of the vehicle. Thus, if the vehicle should move while the data input component is extended, the motion will be detected and the data input component can be rapidly withdrawn from the vehicle to reduce the possibility of damage to the vehicle or apparatus.

It should be realised that acoustic sensor devices may be employed as an alternative to the optical sensor means 36 and optical sensor device 37.

FIG. 6 shows one possible carriage mechanism for the embodiment of FIG. 4. In this carriage mechanism, two rigid arms 70 extend horizontally through vertical slots 71 cut into the face of an automatic bank teller machine 39. The arms 70 are capable of being moved by motors (not shown) behind the face of the automatic bank teller machine, vertically and horizontally away from or towards the automatic bank teller machine 39. Ends 72 of the arms 70 remote from the face of the automatic bank teller machine are bent at right angles to extend vertically downwards from the horizontal part of the arms. The ends 72 of the arms support a data input component 40. The data input component 40 is constructed in two sections, a rear section 73 and a front section 74. The ends 72 of arms 70 are slidably inserted into vertical channels in the rear section 73 of the data input component. The ends 72 of the arms 70 are provided with teeth which engage with a rotatable toothed pinion 75, and the pinion 75 is mounted in the rear section 73 and can be rotated by a motor (not shown) in the rear section. Rotation of the pinion 75 will cause the data input component 40 to move up or down on the ends 72 of arms 70. Thus, the data input component 40 can be moved vertically by the vertical motions of arms 70, these vertical motions are limited by the extent of the slots 71 and if these limits are reached and it is necessary to provide further vertial motion, this can be achieved by the vertical motion of the data input component on the ends 72 of arms 70.

The front section 74 of the data input component 40 is mounted on to the rear section 73 by means (not shown) secured to a rear face of the front section which abuts a front face 77 of the rear section. The means are slidably engaged in two parallel horizontal slots 76, which extend across the face 77. A toothed rack 78 extends horizontally across the front face 77 to engage with a rotable toothed pinion (not shown) mounted on the rear face of the front section 74. The toothed pinion may be rotatably driven by a motor (not shown) in the front section 74, so that the front section 74 may be moved horizontally and in a direction parallel to the front face 77 of the rear section 73.

The embodiment of the invention shown in FIGS. 7 and 8 has a carriage mechanism which can be mounted to one side of an existing automatic bank teller machine. The carriage mechanism has a rigid hollow arm 41 positioned in a vertically extending slot 42 adjacent the automatic bank teller machine 43. The automatic bank teller machine is surrounded by an armoured collar 44, and recessed in to a wall 45 in which the apparatus and machine is mounted. The arm 41 is driven by motors (not shown) to be capable of vertical and horizontal motion away from and towards the wall and automatic bank teller machine. The arm 41 extends through a closs fitting hole in an armoured plate (not shown) which is slidably mounted in vertical channels (not shown) adjacent and behind the slot 42. The armoured plate is capable of moving vertically with the arm 41 and permits the arm to move horizontally while preventing access to the driving mechanism of the arm 41.

A hollow armoured box 46 is rigidly mounted on an end of the arm 41 remote from the wall 45. The box 46 has an elongate flat upper surface 47 and is mounted on the end of arm 41 so that the long axis of box 46 is horizontal and perpendicular to the long axis of arm 41. A slider 48 is slidably mounted on the surface 47 to be capable of motion in a direction parallel to the longitudinal axis of box 46 as indicated by means of a motor (not shown) in the box 46. Mounted on an end of the slider 48 is a parallelogram-type lever mechanism 50 which may be driven by motors in the slider 48 to pivot about the end of the slider. To the end of the parallelogram lever mechanism 50 remote from the slider mechanism 48 is pivotally secured a data input component 51, such that the data component can be moved in a horizontal plane by pivotal motion of the parallelogram lever mechanism. The component 51 may also provide data if so required. The data input component 51 is equipped with sensors 52 capable of detecting the presence and location of obstacles such as side mirrors near the open window of a vehicle. The data input component 51 is also equipped with height detection means 53 which cooperate with height and detection means 54 mounted statically beneath the automatic bank teller machine 43 to determine the height of the vehicle open window, the horizontal distance of the open window from the data input component and any motion of the vehicle in a manner similar to that described for the embodiment of FIG. 4.

The operation of this embodiment is as follows. When a vehicle parks adjacent the machine its presence is detected by the detection means 54 which determines if the vehicle is stationary and commences scanning to deterine the height of the open window of the vehicle. At this stage the apparatus is in its rest position as shown in FIG. 7 with the arm 41 withdrawn towards the wall and the parallelogram lever mechanism 50 pivoted towards the automatic bank teller machine so that the data input component is against the face of the machine 43. As the detection means 54 scans to determine the height of the open window, the parallelogram lever mechanism 50 pivots to move the data input component 51 away from the automatic bank teller machine 43 to the position shown in FIG. 8, so that the data input component 51 is nearer to the vehicle than any other part of the appartus. It is important that vertical alignment of the detection means 53 and 54 should be maintained throughout the pivotal motion of the parallelogram lever mechanism. To achieve this, the slider 48 is controlled to move back and forth so that the data input component moves in a straight line rather than an arc. The data input component can at this stage be moved up or down, depending on the height of the open window of the vehicle by means of vertical motion of the arm 41 in slot 42. When the data input component 51 reaches the height of the open vehicle window detection means 53 will operate to determine the horizontal distance of the component 51 from the open window and the component 51 can be moved horizontally towards the open window by means of horizontal motion of the arm 41. As the data input component 51 moves toward the window, the sensors 52 operate to detect any obstacles near the window. If any obstacle such as a side mirror are detected the slider 48 may be operated so that the data input component 51 avoids the obstacle in its approach to the window. Once the data input component 51 reaches the open window of the vehicle, it stops and then may be operated as described for the previous embodiments of the present invention.

The advantages of this carriage mechanism are as follows. The carriage mechanism and apparatus may be mounted to one side of an existing automatic bank teller machine. The parallelogram lever mechanism 50 enables the data entry component to be brought up to the face of an automatic bank teller machine which is recessed into the wall. The motion of the data entry component provided by slider 48 may be advantageously employed in combination with sensors 52 mounted on the data entry component, which enable the apparatus to detect any obstruction, such as a wing mirror, close to the open window of a vehicle and to avoid hitting the obstruction as the data entry component extends toward the open vehicle window. Also the slider 48 and box 46 may be employed to counterbalance the weight of the data input component 51.

The embodiment of a data input and dispensing component illustrated in FIGS. 9 and 10 includes a deposit apparatus having a box-like housing 80 which abuts the data input and dispensing component. It is preferably secured to the underside of the data input and dispensing component 81. The housing 80, which could be armoured if required, extends between front and rear faces of the data input and dispensing component 81. It will be realised that the deposit apparatus could also be secured to either side or on top of the data input and dispensing component. The housing is hollow and provided with a front facing aperture 82 and a rearward facing aperture 83, and each aperture is equipped with an automatically lockable flap 84 and 85, respectively. Each of the apertures is of a sufficient size and shape to enable an envelope 86 to be placed within the housing 80. An interior panel 87 provides a floor inside the housing 80, and has a plurality of parallel elongate channels 88, e.g. four or more channels 88, cut into it to extend from the front aperture 82 to the rear aperture 83. The panel 87 can have an upwardly sloped insert in the region adjacent the aperture 82, so that when a letter is placed through the aperture 82 into the housing 80, the sloped insert helps to push or allows the envelope to slide into the housing 80 before tines 91 can intercept the bottom part of aperture 82. A bar 89 is mounted by means (not shown) to two side panels 90, to be capable of a limited rotary motion about its elongate axis and be capable of a linear back and forth motion between the front aperture 82 and the rear aperture 83. The bar 89 during its motion is always parallel to the apertures 82 and 83, and its motion is driven by means of a small electric motor (not shown) which is controlled by a control device. Rigidly mounted on the bar 89 are a plurality of parallel tines 91 corresponding to the number of channels 88 capable of being moved by rotary motion of the bar 89 from a substantially horizontal position to a substantially vertical position at which position they engage in the channels 88.

The operation of this embodiment of the invention is substantially the same as that previously described for embodiments of the invention without a deposit device up to the point at which the data input and dispensing component 81 is first adjacent the open window of a vehicle. When in this position, as for previous embodiments, the user inserts his data card into the data input and dispensing component and operates the keyboard of the data input and dispensing component to identify himself to the apparatus. However, once the apparatus has authorised the user, the user will select what type of transaction he wishes to make, that is either a withdrawal or deposit. With this particular embodiment of the dispensing device, because the dispensing device is preferably secured below the data input and dispensing component 81, it will be below the height of the open vehicle window at this stage in the transaction. Therefore, once the user has selected to make a deposit, the data input and dispensing component will move upwardly until the aperture 82 of the deposit device can be easily reached by the user. The apparatus will automatically unlock the flap 84, so that a user can place an envelope 86 containing the deposit into the housing 80 by way of the aperture 82. At this stage the envelope 86 will be resting on the interior panel 87, and the bar 89 will be in a position adjacent the front aperture 82 and rotated so that tines 91 are in their horizontal position. The flap 84 is closed by the user, which action is detected by a sensing device (not shown) in the deposit device. The data input and dispensing component 81 moves away from its position adjacent the open window of the vehicle to a second position adjacent an aperture in a static safe (not shown). At this position a part of the deposit device extending rearwardly of the data input and dispensing component 81 engages in the aperture of the static safe. The electric motor driving the bar 89 is controlled by the control device to rotate the tines 91 into their vertical position so that they engage in channels 88, and the bar is then caused to move linearly from the front aperture to the rear aperture carrying the envelope with it. As the bar approaches the rear aperture 83, the flap 85 is caused to open so that the envelope 86 can be pushed through the aperture 83 and into the aperture of the static safe. The bar 89 is returned to its initial position with the tines horizontal and adjacent the front aperture 82 and the flap 85 is simultaneously closed. The data input and dispensing component then returns to its initial rest position ready for the next customer.

FIG. 11 shows one possible embodiment of the invention capable of dispensing items other than money. The dispensing apparatus has a data input component 60 which has a chamber 61 within which the items to be dispensed can be carried. A keyboard 62 is provided on the data input component 60 to enable selection of the desired items by a user in a vehicle 63 parked adjacent the machine. A resceptacle 64 for cash money or preferably a credit card or similar payment device is also provided on the data entry component. The items to be dispensed by the apparatus are stored and displayed in a cabinet generally indicated by arrow 65. The items 66 to be dispensed are displayed behind toughened or armoured glass in the cabinet 65. To use the apparatus the driver of the vehicle 63 parks adjacent to the apparatus so that an opened window of a vehicle is oposite the data entry component 60. The data entry component 60 is then moved by a carriage mechanism 67 from a rest position to a position adjacent the open window of the vehicle so that it may be readily reached by the user. The apparatus for moving the data entry component is substantially similar to the apparatus previously described for use with automatic bank teller machines. At the position adjacent the open window the user inserts his credit card, selects which items he wishes to purchase from those displayed in the cabinet and instructs the apparatus accordingly by way of a keyboard 68 on the data entry component. The availability and cost of the items he has selected may be displayed on a screen (not shown) on the data entry component 60. The data entry component 60 is then returned to its rest position. At the rest position the items selected are transfered to the chamber 61 of the data entry component from the cabinet 65. The transfer of the items from the cabinet to the data entry component is achieved by automatic handling machinery (not shown) in the cabinet such as conveyor belts turntables and robot arms. The items transferred may be either those visibly displayed in the cabinet or similar items from a store in the cabinet. The data entry component then returns to the position adjacent the open vehicle window at which position the items and credit card can be retrieved by the user together with any receipt which may be provided by the data entry component. The data entry component then returns to its rest position and the driver drives off the apparatus is then ready for use by the next customer.

Any of the previously described embodiments may be fitted with sensor devices capable of detecting any motion of the vehicle. The purpose of such sensor devices is to detect any motion of the vehicle while the apparatus is in operation particularly when the data entry component is extended. In response to such detected motion the data entry component will rapidly withdraw towards the apparatus and be returned to its rest position, so that the risk of damage to the apparatus or vehicle from such motion is reduced.

What is claimed is:

1. Apparatus for use by a person from an open window in a stationary vehicle, the apparatus comprising means for supporting the apparatus alongside the vehicle, detection means capable of generating electric signals determining the position of an open window, a dispensing component, and carriage means for said despensing component connected to said supporting means and response to said electric signals for effecting movement of said dispensing component to a position adjacent the open window.

2. Apparatus for use from an open window of a stationary vehicle, the apparatus comprising means for supporting the apparatus alongside the vehicle, detection means capable of generating electric signals determining the position of said open window, a data input and dispensing component, and carriage means mechanically coupled between said supporting means and said data input and dispensing component and driven in response to signals from said detection means for providing horizontal and vertical movement of said data input and dispensing component from an at rest position on said supporting means to a position adjacent said open window.

3. Apparatus as claimed in claim 2 in which said detection means incluses means (is provided to detect) for detecting the presence of the vehicle.

4. Apparatus as claimed in claim 2 in which the detection means comprises optical sensing means.

5. Apparatus as claimed in claim 2 in which the detection means comprises acoustical sensing means.

6. Apparatus as claimed in claim 2 wherein said detection means comprises a first sensor means mounted vertically beneath the data input and dispensing component, and a second sensor device mounted on the data input and dispensing component to move therewith, so that the first sensor means is capable of detecting the height of an open vehicle window up to the height of the rest position of the data input and dispensing component, and the second optical sensor device is capable of detecting the height of an open vehicle window equal to, or in excess of, the height of the rest position of the data input and dispensing component.

7. Apparatus as claimed in claim 6 in which said first sensor means is a single vertically movable sensor device.

8. Apparatus as claimed in claim 6 in which said first sensor means is a plurality of sensor devices statically mounted at spaced intervals.

9. Apparatus as claimed in claim 6 in which a second detection means is provided to determine the horizontal distance of the vehicle window from the apparatus.

10. Apparatus as claimed in claim 6 in which said carriage means has an arm extending horizontally from a housing of the apparatus to be capable of vertical motion and horizontal motion away from and toward the housing of the apparatus.

11. Apparatus as claimed in claim 10 in which the data input and dispensing component is mounted on an end of said arm remote from the housing.

12. Apparatus as claimed in claim 11 in which the data input and dispensing component is mounted on a parallelogram lever mechanism.

13. Apparatus as claimed in claim 10 in which the data input and dispensing component is slidably mounted on a rod which extends horizontally and perpendicular to the arm to enable the data entry and dispensing component to move in a direction parallel to the longitudinal axis of the rod.

14. Apparatus as claimed in claim 2 for use with a money dispensing automatic bank teller machine in which the data input dispensing component also comprises two rows of rollers which rollers are motor driven and biased together, the rows of rollers being laid out in a passage from a back face of the data input component which faces toward the automatic bank teller machine to a front face of the component which faces toward the vehicle, rear operations being provided in the fear facing part of the passage to receive money from the money output point of the machine and a front aperture being provided to present the money for recovery by the person.

15. Apparatus as claimed in claim 2 wherein the apparatus also comprises a a deposit device abutting the data input and dispensing component, the deposit device being capable of receiving a package from a user in a vehicle while the data input and dispensing component is adjacent the open window of the vehicle.

16. Apparatus as claimed in claim 15 for use with static deposit means having a receiving aperture in which said deposit device comprises a housing having an inlet aperture by means of which a package may be placed in the housing by the user, and outlet aperture capable of mating with the receiving aperture of the deposit means when moved adjacent thereof by the carriage mechanism, and an ejection means in the housing for ejecting the package through the outlet aperture into the deposit means.

17. Apparatus as claimed in claim 16, in which the ejection means comprises at least one member mounted inside the housing to move linearly between the inlet and outlet aperture, the member engaging with any package inside the housing to eject it from the housing through the outlet aperture.

18. Apparatus as claimed in claim 15 in which the inlet and outlet apertures are provided with automatically locking and unlocking closure means to prevent unauthorised use of the deposit device.

19. Apparatus as claimed in claim 15 in which the deposit apparatus abuts the underside of the data input and dispensing component.

20. Apparatus as claimed in claim 2 in which the data input and dispensing component and any exposed parts of the carriage means are armoured to reduce the possibility of damage to the apparatus.

21. Apparatus as claimed in claim 2 wherein the data input and dispensing component contains data input means for instructing the carriage means to move the component between said window position and said rest position.

22. Apparatus as claimed in claim 21 wherein said data input and dispensing component also contains dispensing means for collectin and transmitting materials between said rest position and said window position.

23. Apparatus as claimed in claim 2 wherein said detecting means contains a first sensor located alongside said vehicle and generating first electric signals discriminating between the existence of a side of an adjacent vehicle and an open space above said side thereby to indicate the presence of an open window, said carriage means being driven vertically by said first signals to a position related to the height of the beginning of said open space.

24. Apparatus as claimed in claim 23 wherein said detecting means also contains a second sensor carried by said data input and dispensing component for generating second electric signals indicating the location of said vehicle, said carriage mens being driven horizontally by said second signals to a position adjacent said vehicle.

25. Apparatus as claimed in claim 24 wherein both said first and second sensors are carried by said data input and dispensing component and said second sensor is located below said first sensor whereby said second sensor may continue to indicate the location of said vehicle when the data input and dispensing component is alongside said open space.

26. Apparatus for use from and open window of a stationery vehicle, the apparatus having detection means capable of determining the position of the open window, a data input and dispensing component having a rest position and provided with data input means to enable a user to instruct the apparatus as to a transaction, carriage means activated by said detection means for providing horizontal and vertical movement of said data input and dispensing component between said at rest position and a position adjacent the open window, said detection means comprising a first sensor means mounted vertically beneath the data input and dispensing component and a second sensor device mounted on the data input and dispensing component to move therewith so that the first sensor means is capable of detecting the height of an open vehicle window up to the heights of the rest position of the data input and dispensing component and the second sensor device is capable of detecting the height of an open vehicle window equal to, or in excess of, the height of the rest position of the data input and dispensing component, whereby input of date may cause the component to return to the rest position to collect material to be dispensed and to return to a position adjacent the open window to allow collection by the operator of the material dispensed.

27. Apparatus as claimed in claim 20 in which the carriage means providing vertical movement comprises a back plate slidably mounted to allow only vertical motion and which incluses cables secured to the back plate and coupled to pulleys operable by motors to cause vertical motion.

28. Apparatus as claimed in claim 27 in which a potentiometer is coupled to at least one of the pulleys to enable any vertical distance to be determined.

29. Apparatus as claimed in claim 28 in which the carriage means providing horizontal movement comprises fluid driven pistons capable of providing the horizontal motion.

30. Apparatus as claimed in claim 28 in which the data input component is carried on a horizontal motion assembly.

31. Apparatus as claimed in claim 28 further including a third sensing means to determine the distance of the body of the vehicle from the apparatus and to stop the horizontal motion of the carriage mechanism before contact with the body occurs.

* * * * *